US006539195B2

(12) United States Patent
Sakaba et al.

(10) Patent No.: US 6,539,195 B2
(45) Date of Patent: Mar. 25, 2003

(54) CLEANING DEVICE FOR A FIXING UNIT

(75) Inventors: Eita Sakaba, Ibaraki (JP); Masami Takeshita, Ibaraki (JP); Masato Miwa, Ibaraki (JP); Osamu Nishino, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/015,900

(22) Filed: Dec. 17, 2001

(65) Prior Publication Data

US 2002/0122680 A1 Sep. 5, 2002

(30) Foreign Application Priority Data

Mar. 2, 2001 (JP) ..... 2001-057551

(51) Int. Cl.[7] ..... G03G 15/20

(52) U.S. Cl. ..... 399/326; 15/256.5; 118/257; 399/327

(58) Field of Search ..... 399/326, 327, 399/325, 324, 352, 384; 15/256.5; 118/257, 104, 60; 242/563, 565; 400/708, 703

(56) References Cited

U.S. PATENT DOCUMENTS 5,327,203 A * 7/1994 Rasch et al. ..... 118/257
5,758,982 A * 6/1998 Yoshida et al. ..... 242/563
5,978,640 A * 11/1999 Segawa ..... 399/325
6,091,923 A * 7/2000 Yamamuro ..... 118/60

FOREIGN PATENT DOCUMENTS

JP 07-311517 * 11/1995
JP 10-307503 * 11/1998

* cited by examiner

*Primary Examiner*—Sophia S. Chen
(74) *Attorney, Agent, or Firm*—McGinn & Gibb, PLLC

(57) ABSTRACT

A cleaning device for a fixing unit includes a winding shaft for holding a cleaning web and a sensor for detecting a trailing end of a cleaning web. A notched portion is formed in a winding shaft at a position opposing a detecting position of said sensor.

13 Claims, 1 Drawing Sheet

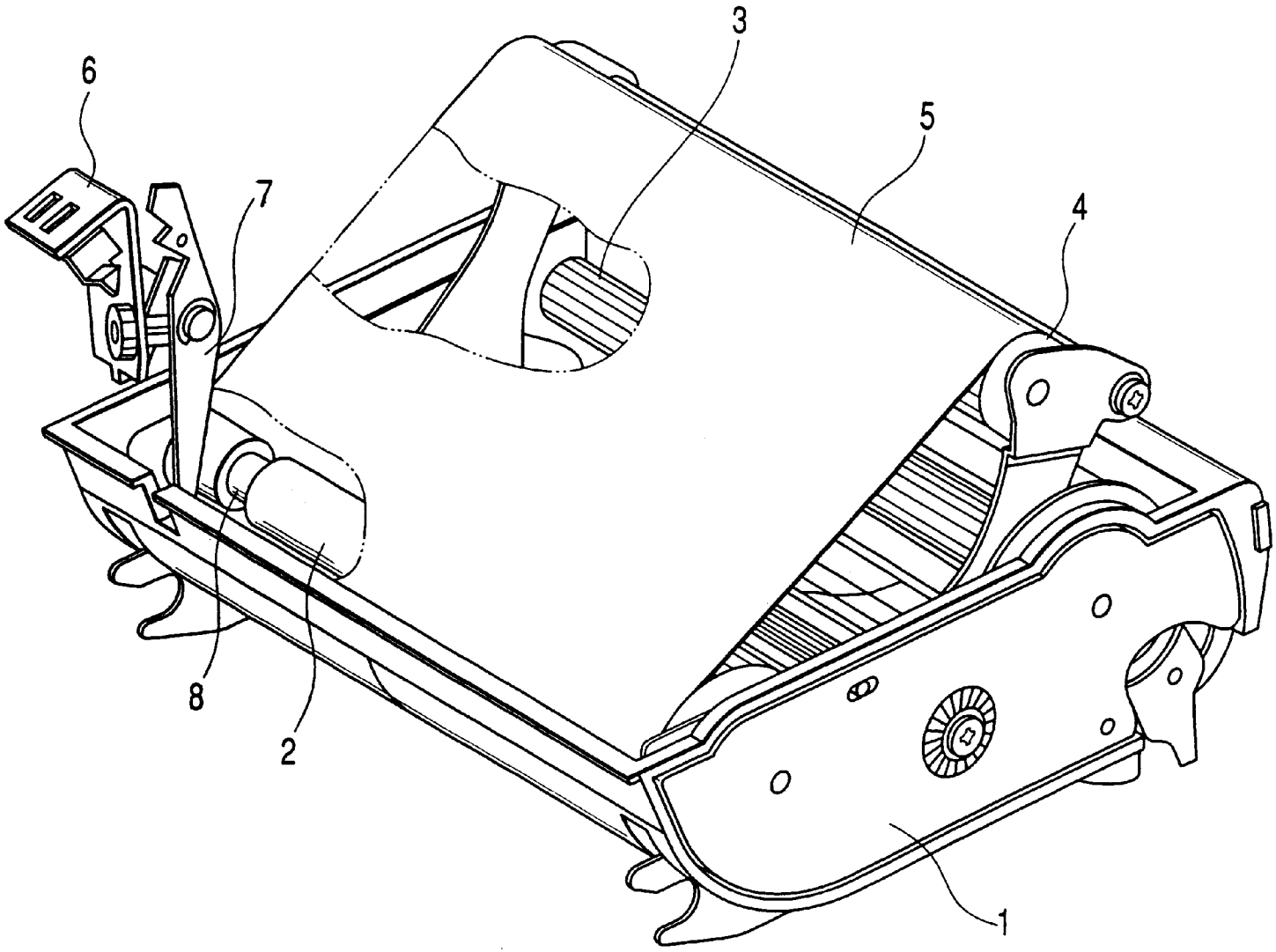
1
2
3
4
5
6
7
8

CLEANING DEVICE FOR A FIXING UNIT

BACKGROUND OF THE INVENTION

1. Field of the Invention

The present invention relates to a cleaning device for a fixing unit used in an electrophotographic apparatus such as a printer and a copying machine.

2. Description of the Related Art

In a conventional cleaning device for a fixing unit used in an electrophotographic apparatus, an actuator of a sensor is made to abut against an outer peripheral portion of an unused web whose diameter gradually decreases as the web is taken up, and the position of the actuator is detected by the sensor so as to detect a trailing end of the web.

In a conventional cleaning device for a fixing unit, a system is used in which the trailing end of the web is detected by detecting the outside diameter of the unused web by a sensor. However, the difference between the outside diameter of the unused web and the outside diameter of the shaft is small in the vicinity of the trailing end of the web, so that it has been difficult to discern whether or not the web still remains depending on the sensitivity of the sensor. In addition, since cleaning becomes faulty if the web is used up, it has been necessary to detect the trailing end of the web with sufficient leeway. For this reason, there has been a problem in that the unused web is wasted.

SUMMARY OF THE INVENTION

An object of the present invention is to solve the above problem.

To overcome the above-described problem, in a cleaning device for a fixing unit in accordance with the invention, a notched portion is formed in a winding shaft, which has an unused web wound therearound, at a position opposing a detecting position of a sensor. When a trailing end of the web comes to be exposed, and the web is disengaged from the wining shaft, the diameter of the notched portion of the winding shaft is measured although the diameter of the web was being measured up until then, so that the diameter changes substantially. For this reason, an output of the sensor also changes substantially, and the trailing end of the web can be detected easily without being affected by the sensitivity of the sensor.

In the cleaning device for a fixing unit having the above-described arrangement, the web may be impregnated with silicone oil to exhibit an oil applying function.

BRIEF DESCRIPTION OF THE DRAWINGS

The FIGURE is a perspective view illustrating an embodiment of the cleaning device for a fixing unit in accordance with the invention.

DETAILED DESCRIPTION OF THE PREFERRED EMBODIMENTS

Referring now to the drawing illustrating an embodiment, a description will be given of the invention.

As shown in the FIGURE, a cleaning device for a fixing unit includes a frame 1, a shaft 2 with an elongated unused web 5 wound therearound, a web takeup shaft 3, a roller 4 for pressing the web 5 against a heating roller (not shown) or a pressure roller (not shown), and a web-trailing-end detecting sensor 6 attached to a printer (not shown). As the web 5 cleans the heating roller (not shown) or the pressure roller (not shown), the web 5 is taken up onto the web takeup shaft 3. When a trailing end of the web 5 comes to be exposed, and the web 5 is disengaged from the shaft 2 around which the unused web 5 was wound, an actuator 7 of the sensor 6 falls into a notched portion 8 of the shaft 2 to detect the trailing end of the web.

As for the shape of the notched portion, the shaft diameter may be made small as shown in the drawing, or a similar effect can be obtained if a V-cut or a D-cut is formed in the shaft 2. In addition, the amount of the notch may be set in conformity with the sensitivity of the sensor, or may be made large for assurance's sake. A noncontact-type photo sensor or the like may be used as the sensor.

It should be noted that, as an example of the fixing unit used in the invention, a fixing unit for an electrophotographic apparatus is known which is used for fixing an unfixed toner image on recording paper formed by a photoconductor, a charging unit, an optical unit, a developing unit, and a transfer unit.

In this embodiment, the web may be impregnated with silicone oil to exhibit an oil applying function.

As described above, in accordance with the invention, since an output of the sensor fluctuates substantially after the trailing end of the web is disengaged from the winding shaft, the trailing end of the web can be detected easily without being affected by the sensitivity of the sensor, so that the unused web is prevented from being discarded wastefully.

What is claimed is:

1. A cleaning device for a fixing unit through which recording paper with an image formed thereon is passed, said cleaning device being adapted to effect cleaning by pressing a web against a portion of the fixing unit, said cleaning device comprising:

a winding shaft for holding an unused portion of the web wound therearound;

a web takeup shaft disposed parallel to said winding shaft for taking up a used portion of the web;

a roller for pressing the web against the portion of the fixing unit; and a sensor for detecting a trailing end of the web, wherein a notched portion is formed in said winding shaft at a position opposing a detecting position of said sensor.

2. The cleaning device for a fixing unit according to claim 1, wherein the web is impregnated with silicone oil to exhibit an oil applying function.

3. A cleaning device for a fixing unit, said cleaning device comprising:

a winding shaft for holding a cleaning web; and a sensor for detecting a trailing end of said cleaning web, wherein a notched portion is formed in said winding shaft at a position opposing a detecting position of said sensor.

4. The cleaning device as claimed in claim 3, further comprising:

a web takeup shaft disposed parallel to said winding shaft for taking up a used portion of the cleaning web.

5. The cleaning device as claimed in claim 4, further comprising:

a roller for pressing a portion of said cleaning web between said winding shaft and said web takeup shaft against a portion of the fixing unit.

6. The cleaning device as claimed in claim 3, wherein said sensor comprises an actuator which detects when the cleaning web is disengaged from said winding shaft.

7. The cleaning device as claimed in claim 6, wherein the actuator senses the trailing end of the cleaning web when a contact with the cleaning web by the actuator is interrupted.

8. The cleaning device as claimed in claim 3, wherein said sensor comprises a noncontact photosensor.

9. An electrophotographic apparatus comprising the cleaning device of claim 3.

10. A fixing unit with a cleaning device, said cleaning device comprising:

a frame;

means for winding an unused portion of the web supported by said frame; and means for detecting a trailing end of the web at a position opposing said winding means, wherein said winding means comprises a notched portion.

11. The fixing unit with a cleaning device as claimed in claim 10, further comprising:

means for taking up a used portion of the web disposed parallel to said winding means.

12. The fixing unit with a cleaning device as claimed in claim 10, wherein the notched portion is formed at a position opposing a detecting position of said detecting means.

13. The fixing unit with a cleaning device as claimed in claim 10, wherein said detecting means comprises an actuator which detects when the web is disengaged from said winding means.

* * * * *